US007010383B2

(12) United States Patent
Zipperer

(10) Patent No.: US 7,010,383 B2
(45) Date of Patent: Mar. 7, 2006

(54) METHOD FOR CONTROL OF THE TRAVEL MOVEMENT OF AT LEAST ONE SERVICE UNIT AT A TEXTILE MACHINE

(75) Inventor: Martin Zipperer, Denkendorf (DE)

(73) Assignee: Rieter Ingolstadt Spinnermaschbau AG, Ingolstadt (DE)

( * ) Notice: Subject to any disclaimer, the term of this patent is extended or adjusted under 35 U.S.C. 154(b) by 267 days.

(21) Appl. No.: 10/202,451

(22) Filed: Jul. 24, 2002

(65) Prior Publication Data

US 2003/0036816 A1 Feb. 20, 2003

(30) Foreign Application Priority Data

Jul. 28, 2001 (DE) ..... 101 36 983
Sep. 29, 2001 (DE) ..... 101 48 330

(51) Int. Cl.
*G06G 7/66* (2006.01)

(52) U.S. Cl. ..... 700/139

(58) Field of Classification Search ..... 57/268, 57/1 R, 264, 263; 104/173.1; 700/139, 130, 700/143

See application file for complete search history.

(56) References Cited

U.S. PATENT DOCUMENTS

| | | | | |
|---|---|---|---|---|
| 4,192,129 A | * | 3/1980 | Stahlecker | 57/301 |
| 4,418,525 A | | 12/1983 | Raasch | |
| 4,532,759 A | | 8/1985 | Bischofberger | |
| 4,768,443 A | | 9/1988 | Bruggisser et al. | |
| 4,840,022 A | * | 6/1989 | Karl et al. | 57/263 |
| 4,890,450 A | | 1/1990 | Karl et al. | |
| 4,944,033 A | | 7/1990 | Erni | |
| 5,347,449 A | | 9/1994 | Meyer et al. | |
| 5,386,684 A | | 2/1995 | Simon et al. | |
| 5,801,949 A | | 9/1998 | Raasch et al. | |
| 6,014,592 A | | 1/2000 | Fechter et al. | |
| 6,226,971 B1 | | 5/2001 | Stephan | |
| 6,474,461 B1 | | 11/2002 | Grabovszky | |
| 2003/0036816 A1 | | 2/2003 | Zipperer | |
| 2003/0056487 A1 | | 3/2003 | Zipperer | |

FOREIGN PATENT DOCUMENTS

| | | |
|---|---|---|
| DE | 2454483 C2 | 5/1976 |
| DE | 3900229 A1 | 7/1990 |
| DE | 3909746 A1 | 10/1990 |
| DE | 3942916 A1 | 7/1991 |
| DE | 4221504 C2 | 1/1993 |
| DE | 4212629 A1 | 10/1993 |
| DE | 4216512 C2 | 11/1993 |
| DE | 19547068 | 6/1997 |
| EP | 0433775 B1 | 12/1990 |

OTHER PUBLICATIONS

German Patent Office Search Report Mar. 13, 2002.
Patent Abstract of Japan No. 59069367A.

* cited by examiner

*Primary Examiner*—John J. Calvert
*Assistant Examiner*—Brian Kauffman
(74) *Attorney, Agent, or Firm*—Dority & Manning, P.A.

(57) ABSTRACT

The invention relates to a method for the control of the travel movement of at least one service unit at a rotor-spinning machine, whereby the service unit services and/or controls an operating zone assigned to it containing a plurality of processing stations of the textile machine. The service unit is moved in the direction of its assigned operating zone when the detected position is located outside the assigned operating zone. In addition, the size of the operating zones is determined as a function of the workload of the service units and/or of the work efficiency of the service units.

17 Claims, 2 Drawing Sheets

METHOD FOR CONTROL OF THE TRAVEL MOVEMENT OF AT LEAST ONE SERVICE UNIT AT A TEXTILE MACHINE

BACKGROUND

The present invention relates to a method for the control of the travel movement of at least one service unit at a textile machine, whereby the at least one service unit services and/or controls an operating zone with a plurality of processing stations of the textile machine assigned to it.

In a known open-end spinning machine (DE 199 30 644 A1), identical service units can be moved alongside a plurality of spinning stations along a guide rail of the open-end spinning machine. Each service unit is assigned an operating zone in which this service unit services the spinning stations. The operating zones may overlap in this case. If one of the service units stops operating and the service unit is pushed into an appertaining waiting position, the operating or servicing zone of the non-operative service unit is assigned to the other service units. When the service unit taken out of operation is again put into operation, the original operating zones are again assigned.

SUMMARY

It is an object of the invention to provide a method for the control of the travel movement of at least one service unit, optimizing the travel movement of one or more service units. Additional objects and advantages of the invention will be set forth in part in the following description, or may be obvious from the description, or may be learned through practice of the invention.

With an embodiment of a method according to the invention, the travel movement of a first service unit is controlled at a textile machine. The first service unit is assigned an operating zone on the textile machine in which it services and/or controls a plurality of processing stations. By way of a detection device on the textile machine, the current position of the service unit at the textile machine is continuously detected. In the case of continuously numbered processing stations, this position is e.g. the number of the processing station at which the service unit is at the moment. Alternatively, the position is found by measuring or calculating a distance. If the detected position of the first service unit lies outside its assigned operating zone, the first service unit is moved back to its assigned operating zone. The service unit may be outside its assigned operating zone if the operating zones have been newly determined and the position of the service unit in the original displaced or extended operating zone is no longer within the present operating zone, or else the service unit was pushed out of its assigned operating zone by an operator. Alternatively, the service unit may have been in a service position that is also outside the operating zone.

By returning the service unit into its assigned operating zone, the service unit is prevented e.g. from continuing its already started travel away from its assigned operating zone, which could extend as far as a return point at the end of the textile machine, while the processing stations located within its operating zone are not being serviced during that time. Thereby, the operating efficiency of one or several service units is improved. Collisions or avoidance maneuvers by the service units having been assigned new operating zones are avoided, as such would also be detrimental to operating efficiency.

Service units are normally automats carrying out different tasks at the processing stations of the textile machine, i.e.

cleaning robots or similar devices. Such operations are e.g. the cleaning of the operating stations, the re-starting of the operating station after a stoppage or the presentation of initial products, etc. In an open-end spinning machine for example, a piecing robot additionally exchanges bobbins when a bobbin is filled with spun yarn, or it pieces the yarn at the spinning station in case of yarn breakage.

Thanks to the automatically controlled return of the service unit into its operating zone, it is not necessary to push it manually into the operating zone and to put it into operation therein. The control of the travel movement is carried out preferably by a control system of the service unit and/or of the textile machine. A hierarchical division of the travel path control by interaction between the control system of the service unit and of the textile machine is broken down preferably in adaptation to the existing, hierarchical division of the control units. The control of the travel movement of a service unit is assumed for instance by its control system, whereby the latter makes available data via the control system of the textile machine (central machine controls) concerning other service units, travel path limits or predetermined return points. Alternatively, the travel movement control is assumed by the control system of the textile machine, e.g. the central machine controls, so that only movement commands are transmitted from it to the control system of the service unit.

To increase the operating efficiency of the service unit during its travel to its assigned operating zone, the processing stations requiring service or control that are serviced by the service unit on its way to its assigned operating zone. Especially when the approach distances to the operating zone of the service unit are long, unproductive travel is thereby avoided. This is especially advantageous in the case of several service units, e.g. when all the operating zones have been newly defined, and when every service unit would have to make an unproductive trip to its new operating zone without servicing and/or controlling the processing stations on their way thereto.

If it is found that the service unit is outside its operating zone and is furthermore being moved further away from it and/or if it is stopped on its return travel to its operating zone, e.g. by an obstacle, the automatic travel mode of the service unit is interrupted or switched off. An interruption or disconnection also takes place e.g. when the service unit recognizes in automatic travel mode on the one hand that it is outside its operating zone, while however another routine of the travel movement control indicates a travel direction leading away from the assigned operating zone. The latter occurs e.g. when a detection device recognizes an obstacle in the direction of the operating zone and initiates a reversal of travel direction because of the obstacle or would initiate such a reversal. As a result, the service unit (temporarily) no longer executes any autonomous travel movement. If for example an obstacle is present in the travel path of the service unit, preventing the service unit from reaching its assigned operating zone, the service unit no longer bumps continuously against the obstacle as before thanks to the automatic travel movement control. An interruption of the automatic travel movement control is desirable also when an operator pushes the service unit, e.g. into a service position, where the service unit is serviced or controlled. If the travel movement control is merely interrupted, it is possible, after a certain waiting time, to undertake a renewed attempt to return to the assigned operating zone. When the travel movement control is switched off it is preferably resumed only when released by the operator.

Simultaneously with or alternatively to the interruption or switching off of the automatic travel movement control, the service and/or control mode is also interrupted or switched off. This prevents the service unit from carrying out servicing or control functions in a position that is undefined for the automatic travel movement control.

In an especially advantageous embodiment, the position of the service unit is transmitted or detected when the automatic travel movement control or the service and/or control functions of the service unit are switched off or interrupted. Thereby the actual position of the service unit is continuously updated for the control unit for the control of the travel movements, for example if the service unit is pushed by an operator alongside the textile machine. Thereby the service unit need not be re-initialized upon resumption of the automatic travel movement control, in that its current position at the textile machine must be determined through an initialization trip. The manual displacement of the service unit, e.g. by an operator, can be realized either by manual pushing or by a travel control whereby the operator e.g. continuously holds down a forward or reverse travel key. While the key is held down the service unit is displaced into the wanted direction by its own drive. Releasing the key stops the service unit.

If the first service unit encounters e.g. a second service unit during its return to its operating zone, a minimum distance between the service units is maintained. For this purpose the data on the second service unit for example, is made available to the control unit to control the travel movement. This data of the second service unit preferably comprises the position, the speed, the operating status, etc. The data is transmitted e.g. via a communications system between each service unit and the central machine controls. It is also possible to provide for the appropriate data to be exchanged directly among the service units. Such a data exchange can be effected e.g. through an optical communications connection among the service units. Alternatively, a distance detection unit can be used to recognize the presence of a second or additional service unit.

In an embodiment of the method for the control of the travel movement of at least two service units at a textile machine, the size of the operating zones of the (at least two) service units is determined as a function of the workload and/or the work efficiency of the service units. Thus, the size of the operating zones is adapted dynamically to the capacity of each service unit individually, or the size of the operating zones is determined as a function of the degree to which the processing stations in the assigned operating zones are in fact needy of service. The workload of a service unit depends e.g. on the time required for servicing and/or controlling the processing stations. The workload increases e.g. when an especially large number of processing stations in the operating zone of the service unit require servicing. The workload drops e.g. when not all the processing stations are in operation in the operating zone of the service unit or when part of the processing stations cannot be serviced by the service unit. The work efficiency of a service unit increases e.g. when the latter pieces successfully already for the first time as it pieces anew, in the case of an open-end spinning machine, while the work efficiency is low if the processing station can resume operation only after several piecing attempts.

The work efficiency or the workload can also be defined separately for selected, special functions from the overall servicing and/or control program of the service unit. The work efficiency and the workload depend in part on each other.

Through the adaptation of the size of the operating zones, the workload of the service units is equalized among them. The automatic travel movement control then takes place in the newly assigned operating zones so that the overall work efficiency of all the service units at the textile machine is optimized. The determination of the operating zones can be updated continuously. It is however updated preferably at intervals, e.g. every 5 minutes, by calculating first the mean values of the work efficiency and of the workload continuously or for the elapsed time interval, so that unproductive travel of the service units following new determination of the service zones can be avoided as much as possible. An adaptation of the operating zones can take place at shorter intervals if considerable changes occur in workload or work efficiency, i.e. in case of a high time gradient, e.g. when many processing stations have stopped operation in a zone because a service unit was unable to enter this zone because of an obstacle.

If the operating zones of the service units are allowed to overlap so that part of the processing stations can be serviced by two or more service units, the size of this overlapping area is determined preferably as a function of the workload and/or the work efficiency of the service unit. The size can be determined e.g. as described above with regard to the operating zone.

In an especially advantageous embodiment, an operating zone related to a particular function is determined for different functions of the service units. If for instance only one of the service units at an open-end spinning machine is able to replace a bobbin or apply the fiber sliver, all the processing stations are assigned to the operating zone of that service unit for this special function. Or if the piecing function following a bobbin replacement is omitted by one piecing robot of an open-end spinning machine because the piecing robot no longer has any reserve of piecing yarn, one or several adjoining service units take over the servicing task for this special function. The piecing robot carries out all other functions without piecing yarn without change, e.g. the piecing following a yam breakage where no bobbin replacement has occurred. Also, an individual processing station of the textile machine may not be serviced or not be serviced efficiently by a first service unit in whose operating zone the processing station is located. In that case the controls no longer bring the first service unit to that processing station, but the processing station is assigned to another service unit which enters the operating zone of the first service unit if necessary and services this particular processing station.

If a first service unit is prevented from completely servicing its operating zone, e.g. because an obstacle such as an operator impedes its travel to the processing stations, another service unit can travel e.g. from the other direction to the processing stations that are not accessible to the first service unit.

The embodiments of the invention are explained in further detail through drawings.

DESCRIPTION

Reference will now be made in detail to one or more embodiments of the invention illustrated in the figures, such embodiments being presented by way of explanation of the invention, and not as a limitation of the invention.

Figure 1:
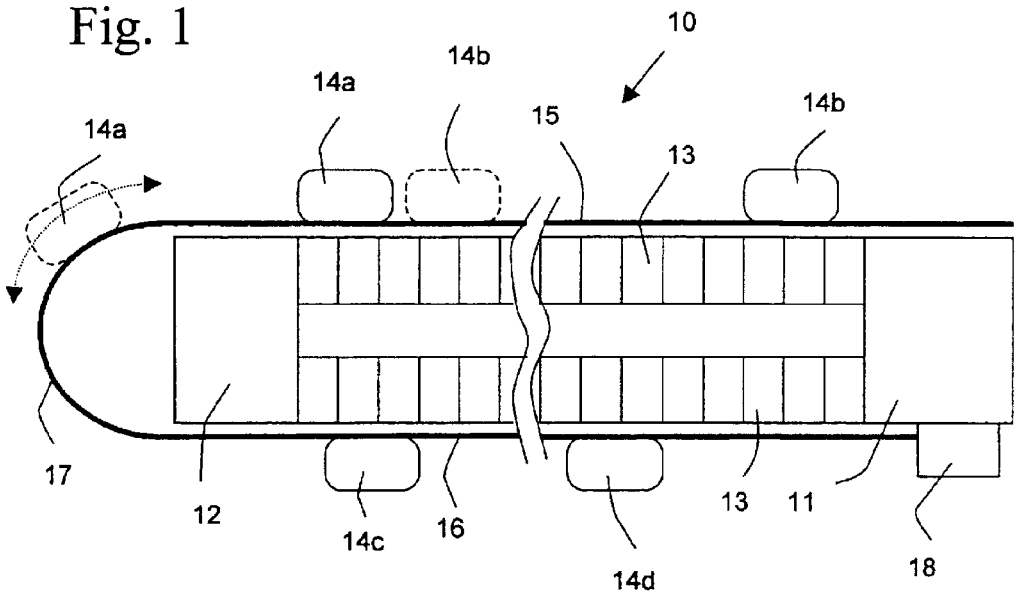
FIG. 1 shows a schematic top view of a rotor spinning machine with two piecing robots per spinning machine side.

FIG. 1 shows schematically a top view of a rotor-spinning machine 10 with two piecing robots 14*a–d* per spinning machine side. A plurality of spinning stations 13 are installed on both sides of the rotor-spinning machine 10 between an end frame 11 and a drive frame 12 of the rotor-spinning machine 10. A bobbin-feeding device 18 is mounted to the end frame 11 to feed empty bobbins to the end frame for distribution along the spinning stations 13. The drive aggregates of the common drive of the spinning stations 13 are located in a known manner in the drive frame 12. In reality a greater number of spinning stations 13 than what is shown is located between the frames 11, 12, as indicated by the interruption lines.

The piecing robots 14*a–d* described in further detail in the following embodiments serve to piece the yarn, to replace bobbins, to clean the spinning stations 13 etc., as is generally known.

Parallel with the spinning stations 13, a guide rail 15, 16 extends on either side of the rotor-spinning machine 10. On the guide rail 15, 16 the piecing robots 14*a–d* are mounted on carriages capable of traveling in a known manner. The two guide rail 15, 16 are connected to each other around the drive frame 12 by a round curve 17 so that the piecing robot 14*a* or 14*c* can be moved at the round curve 17, each to the other side. The supply of the piecing robots 14 is ensured in a known manner by means of drag chains that are not shown here, running parallel to the spinning stations 13. The supply lines for the piecing robots 14 such as power supply, a compressed-air channel, control lines, a negative-pressure channel for suction etc., are located in the drag chains.

Figure 2:
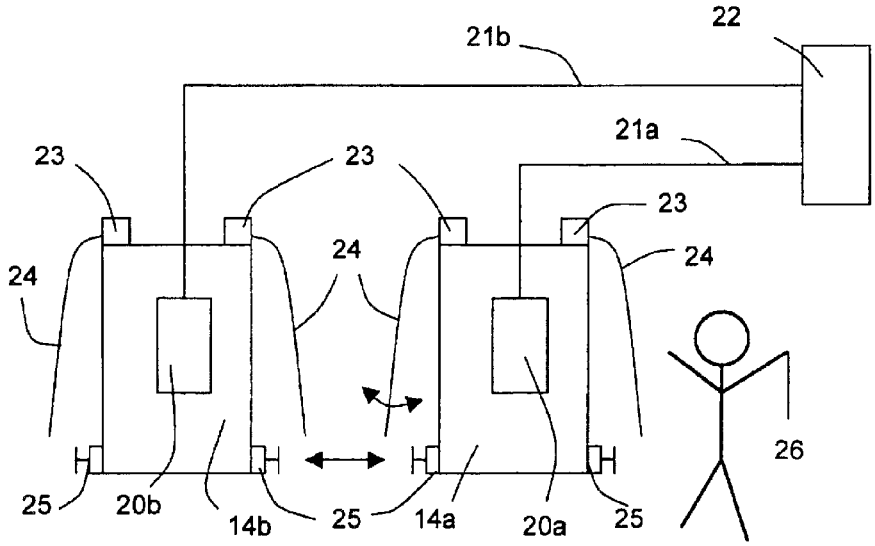
FIG. 2 is a schematic side view of two piecing robots traveling on a common guide rail.

FIG. 2 shows a schematic side view of the piecing robots 14*a,* 14*b*. In the piecing robots 14*a,* 14*b* the control units 20*a,* 20*b* are respectively installed, and these are connected via communications connections 21*a,* 21*b* to a central machine control system or spinning machine control system 22 of the rotor-spinning machine 10. The communications connections 21*a,* 21*b* can be data circuits extending together with the supply lines in the drag chain.

In the upper area of each of the piecing robots 14*a,* 14*b,* a switching unit 23 is located in which a switching hoop 24 is pivotally mounted. The switching hoop 24 protrudes laterally from the piecing robots and extends in the lower area over the width of the piecing robot. The switching hoop 24 is able to swivel towards the piecing robot. The switching hoops 24 are used to detect a lateral obstacle, such as e.g. an operator 26 of the rotor-spinning machine 10, as sketched in FIG. 2. By slight swiveling in of the switching hoop 24, a switching contact is triggered in the switching unit 23 and the piecing robot 14*a,* 14*b* is braked. Furthermore, additional switching steps are provided for further swiveling in of the switching hoop 24 beyond the first contact point. In this case, when the switching hoop 24 swivels in further, a second switching contact is actuated to cause a greater deceleration of the spinning robot. Finally, when the switching hoop is swiveled in completely, a third switching contact is actuated to cause the spinning robot to stop abruptly. In addition an emergency button 25 which also causes the abrupt stopping of the piecing robot when meeting with an obstacle or upon actuation by an operator 26 is provided laterally on each piecing robot.

The absolute positions of the piecing robots (see below) determined in the control unit 20*a,* 20*b* or the spinning machine control system 22 are exchanged, so that the relative distance between two piecing robots can be calculated through the absolute position information. This results in an ascertainment of the distance to another piecing robot which also represents an obstacle on the travel path because of the common travel path along the guide rail 15, 16, 17. In the same manner, the distance between a piecing robot 14*a–d* and an obstacle such as e.g. the bobbin-feeding device 18 is calculated.

Figure 3:
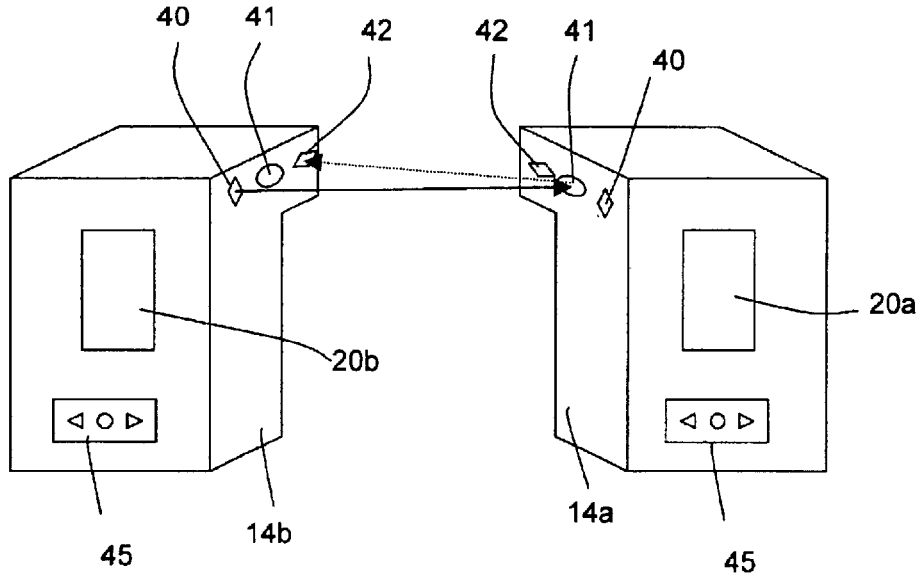
FIG. 3 is a lateral view in perspective of two piecing robots with laterally located detection devices, FIG. 4*a* schematically shows the division of work zones between two piecing robots and FIG. 4*b* schematically shows the division of work zones with an overlapping-zone.

FIG. 3 shows a schematic side view in perspective of the piecing robots 14*a,* 14*b*. Next to each other on the lateral surfaces of the piecing robots 14*a,* 14*b,* a transmission unit 40, a reflector 41 and a receiving unit 42 are installed. The transmission unit 40 emits a light signal that is inclined relative to the vertical of the lateral surface. At a predetermined distance between the piecing robots 14*a,* 14*b,* the ray emitted by the transmission unit 40 and bundled in room direction meets the reflector 41 of the opposite piecing robot. From there the light ray is reflected back at the angle of incidence to the emitting piecing robot 14*b*. There the light ray meets the receiving unit 42. As a result, the receiving unit 42 only detects the signal emitted by the transmission unit 40 when a predetermined distance is kept between the piecing robots 14*a,* 14*b*. To avoid any influence on the receiving unit 42 by a signal coming from the opposite transmission units 40, the detection of the signals is dependent upon wavelengths, whereby a different transmission/receiving frequency is used for each side of the piecing robot 14*a–d*. Alternatively, the signals are modulated differently, depending on the side of the piecing robot, so that the receiving unit 42 detects only the signal emitted by the corresponding transmission unit 40 on the same side.

With this arrangement, the piecing robot 14*b* can also determine the position of the piecing robot 14*a* and vice versa. The determination of position can also be used so that a robot can inform the control unit 20*a,* 20 and/or 22 of the position of a robot out of operation (see below). If for instance the spinning machine control system 22 does not know the position of the piecing robot 14*a,* it can cause the piecing robot 14*b* to find that position. With this position information, the travel movement control of the piecing robot 14*a* can be resumed.

In a collision avoidance control mode, the distance determination process records an obstacle and the distance to the obstacle. By interrogating the data in the control units 20*a,* 20*b,* 22 on end points of the travel path (e.g. bobbin feeding device 18) and the position of the other piecing robots 14*a–d,* it is determined that the obstacle is an unforeseen one, e.g. an operator 26. If this obstacle is located within the range of the spinning stations 13, it is assumed that the obstacle is an operator 26. In order to avoid interference with the operator 26 by the approaching piecing robot 14*a–d,* the piecing robot is moved only to within a predetermined distance from the obstacle. The distance is here determined to be such that the operator 26 does not feel crowded by the piecing robot and is able to perform his service tasks unimpeded.

The described detection devices for the avoidance of collisions can be provided in any desired combination with each other, e.g. a distance detection sensor 40, 41, 42 as in FIG. 3, with a switching hoop 24 and a emergency stop switch button 25 as in FIG. 2, etc. By combining two or more detection devices per travel direction, the reliability of obstacle detection is heightened. Here the determination of position and distance between a piecing robot 14*a–d* and an obstacle by means of one of the control units 20*a,* 20*b,* 22 or the interaction of the control units of a collision avoidance system is used for the obstacles "known" to the spinning machine. Here suitable measures can be for soft braking of the piecing robot in front of the obstacle and/or the controlled approach of the robot to the obstacle can be initiated. The detection devices 23, 24; 25; 40, 41, 42 described above which detect an obstacle with or without contact, serve primarily to recognize "unforeseen" obstacles and intervene even if defects occur in the determination of obstacles by means of the control units 20*a,* 20*b,* 22.

The control unit 20*a,* 20*b* of the piecing robot 14*a–d* and/or of the spinning machine control system 22 controls the braking, stopping, temporary servicing after stopping and/or reversal of the direction of travel of a piecing robot 14*a–d* as a function of the type of the signal received by the detection system.

When a piecing robot has been stopped because of an obstacle, it can reverse its direction of travel immediately after stopping in order to service the spinning stations 13 that are not in the area of the obstacle. The piecing robot can however also wait in this position for a predetermined time after stopping, in case that the obstacle is removed within a predetermined waiting time before reversing its direction of travel. Thereby a lack of servicing for a longer period of time of the spinning stations 13 in the piecing robot's direction of travel before braking is avoided. As a result of the reversal of travel direction, the service unit no longer checks the spinning stations in the original direction of travel, but now those which are in the oposite direction of travel.

Especially in case that position data concerning other piecing robots 14*a–d* and/or reversal points, as well as end points in the travel path of a piecing robot, are made available through the control units 21*a,* 21*b,* 22, the reaction to an obstacle can be controlled as a function of the obstacle itself. Thus for example, end points can be approached without observing the minimum distance indicated for an obstacle. In FIG. 1, the piecing robot 14 can be brought e.g. into immediate proximity of the bobbin feeding device 18, even though a signal of a distance sensor signals an obstacle. In the case of a predetermined reversal point, the travel path of a robot is established by a position determined at will along the guide rail 15, 16, whereby the reversal point is not a physical end of the travel path. Such an end point can be freely defined and determined by one of the control units 20*a,* 20*b* or 22 or by an operator according to appropriate programming.

If an obstacle is detected within an approach distance to another piecing robot and it is recognized through data comparison that this is another piecing robot, then a predetermined minimum distance that may be greater than the safety distance to some other obstacle is observed. This ensures that two piecing robots, whereby one of them may be servicing a spinning station 13, do not interfere with each other. The minimum distance could be e.g. a section width of ten spinning stations 13.

If the servicing function fails in one of the piecing robots 14*a–d,* so that it is no longer available for service at a piecing station 13, the piecing robot is moved into its starting position (for initialization, see below) or into a waiting position. If one is not available, or if another piecing robot must pass that position, an avoidance function of the deactivated piecing robot is actuated. In that case, the deactivated piecing robot avoids an approaching piecing robot or an obstacle operator thanks to the distance recognition, while observing a minimum distance. The minimum distance may be e.g. a section width of 10 spinning stations, and this is cancelled if the defective piecing robot is unable to move any further in avoidance direction because of another obstacle, e.g. the bobbin feeding device 18.

The current position of the piecing robots 14*a,* 14*b* is constantly monitored or calculated by the control units 20*a,* 20*b* or the spinning machine control system 22. This takes place either through an initialization of the position of the piecing robot in its starting position, whereby a position counter is set up along the guide rails 15, 16, 17 at a predetermined position, and the position is then calculated on the basis of the distance of the travel path covered. Alternatively, position markings are placed along the guide rails 15, 16, 17, so that the current position is detected by a detection device (not shown) in the piecing robot 14*a–d* concerned. Instead of measuring the covered travel path or the relative position of a piecing robot taken out of operation, it is also possible for an operator to enter the position of the piecing robot taken out of operation into the control unit. It is however also possible to provide sensors along the travel path to detect the piecing robot and to inform the control units 20*a,* 20*b,* 22 (e.g. the central machine control system) of the position of the piecing robot.

The initialization can take place in one starting position or several starting position that can be selected at will. The determination of positions can also be effected through a combination of initialization, determination of travel path, and position comparison at the position markings. In this case, a position counter at the predetermined starting position is set back after initialization and the distance covered is determined from that location. The latter takes place based on the detection of position markings along the guide rails or else a calculated value of the current position is compared with the detected position. As a rule, the position markings are relative markings, so that the service unit detects only a covered distance based on the relative position marking. The position markings may however also be absolute markings, so that the service unit is able to detect the absolute position at the textile machine at every marking. In the latter case any position marking can be traveled to for initialization.

If the determination of the position of a piecing robot 14*a–d* by the control unit 20*a,* 20*b,* 22 fails, the piecing robot maintains its position until the initialization in the starting position as described above is again carried out and a determination of position is again ensured.

In addition, as shown in FIG. 3, an input device 45 is provided at the front of each piecing robot 14*b,* 14*a*. By actuating the left/right keys of the input device 45, an operator can move the piecing robot manually. As soon as the left or right key is depressed, the automatic travel movement control by a control device is terminated and the piecing robot 14*a,* 14*b* travels in the direction indicated by the arrow for as long as an operator 26 depresses the keys. Thereby the piecing robot can be moved e.g. into a service position 11, 12 (FIG. 4*a*) or can be moved out of a zone of spinning stations, e.g. when spinning stations must be serviced manually by the operator. By depressing the middle key of the input device 45, the automatic travel movement control mode is resumed. In this case the travel movements are again controlled by the control units 20*a,* 20*b,* 22. The automatic travel movement control can be actuated by the operator by means of the middle key of the input device 45 also when e.g. the control program has interrupted or terminated the travel movement control. Thanks to the manual travel direction keys, the operator need not move a piecing robot 14*a,* 14*b* by hand, i.e. by expending force.

Figure 4A:
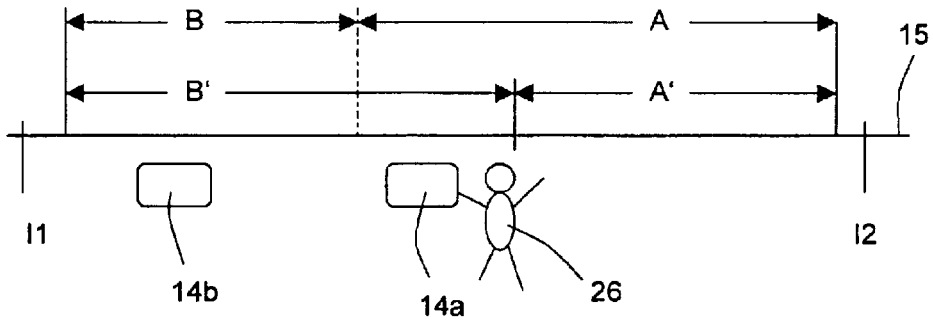

FIG. 4*a* schematically shows the division of operating zones in the rotor-spinning machine 10 among the two piecing robots 14*a,* 14*b*. The spinning stations 13 alongside the guide rail 15 are serviced completely by the two piecing robots 14*a,* 14*b*. Outside the spinning stations 13, two service positions 11 and 12 are provided on the guide rail 15 on the left and on the right. A piecing robot requiring maintenance is moved to the proper service position for maintenance or repair. In this case the piecing robot 14*b* is preferably moved into service position l1 and the piecing robot 14*a* into piecing position l2. When a piecing robot has been brought into its service position, the entire area of the spinning stations 13 is accessible to the other piecing robot. The piecing robot that is not being serviced can therefore completely take over the servicing of the spinning stations 13 along the guide rail 15.

As indicated by the upper arrows A,B, the piecing robot 14*b* services the operating zone B and the piecing robot 14*a* services the operating zone A in the original division. For a total number of e.g. 300 spinning stations per machine side, the piecing robot 14*b* services an operating zone B of 100 spinning stations, for example spinning station No. 1 to spinning station No. 100. The piecing robot 14*a* services an operating zone of 200 spinning stations with the numbers 101 to 300.

As shown in FIG. 4*a,* the piecing robot 14*a* is prevented by the operator 26 from traveling into zone of spinning stations 13 to the right of the operator 26. If the piecing robot 14*a* is prevented for a longer period of time from servicing the spinning stations to the right of the operator 26, the need for service of the spinning station accumulates there. The longer the interruption of travel lasts, the more spinning stations signal a need for servicing, e.g. for reason of a yarn breakage. When the operator 26 has moved away from the travel zone the workload of the piecing robot 14*a* increases considerably and will reach 100%. On the other hand the piecing robot 14*b* was able to service unhindered the spinning stations 13 in its operating zone B so that its workload may only be 30%. If the division into the original operating zones A,B were to be maintained, the piecing robot 14*a* would require some time until all the spinning stations 13 would be operative once more. However, in order to achieve a more even workload of the piecing robots 14*a,* 14*b,* the operating zones are established anew. In the new division of the operating zones the current workloads of the piecing robots 14*a,* 14*b* are taken into account. As an example, the average workload of the piecing robot 14*b* is 30% for the last 3 minutes, and that of the piecing robot 14*a* is 100%. The size of the new operating zone A' of the piecing robot 14*a* is then calculated as follows:

$$N_{A'}=N/2(100\%-A+B)=N/2\times30\%=150\times30\%=45$$

The new size of the operating zone B' of the piecing robot 14*b* is calculated as follows:

$$N_{B'}=N/2(100\%+100\%-30\%)=150\times170\%=255.$$

Thereby the new operating zone A' would cover 45 spinning stations and the new operating zone B' 255 spinning stations.

The new division is given here only as an example. The calculation for the determination of the new sizes of the operating zones can be made by other means. For example, the number of spinning stations having actually signaled that they require servicing can be taken into consideration and the new operating zones A', B' can be divided so that both piecing robots 14*a,* 14*b* will have an equal number of spinning stations to service in their new zones.

The new operating zones can be adapted e.g. every 3 minutes or be triggered only when e.g. the work loads of the piecing robots 14*a,* 14*b* diverge by more than 20% from each other, or when the number of the spinning stations actually requiring servicing within the operating ranges diverge from each other e.g. by more than 10 spinning stations requiring servicing per piecing robot.

Figure 4B:
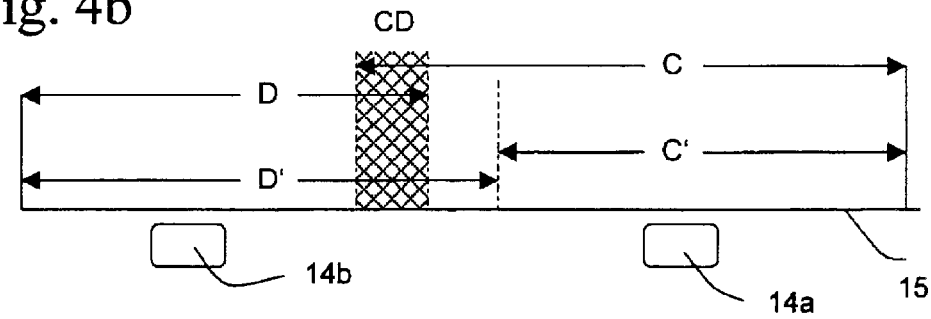

FIG. 4*b* shows the case of originally overlapping operating zones C, D of the piecing robots 14*a,* 14*b*. The operating zones C, D have an overlapping zone CD in which the spinning stations 13 can be serviced either by the piecing robot 14*a* or by the piecing robot 14*b*. This has the advantage that the piecing robot 14*b* for example need not enter the overlapping zone CD from the outermost left end of its operating zone B when the piecing robot 14*a* is already at the outermost left end of its operating zone C. A spinning station 13 requiring servicing is then serviced in the overlapping zone CD by that piecing robot 14*a,* 14*b* which has the shorter approaching distance. As a result, the time until restarting the spinning station 13 is shorter and the productivity of the rotor-spinning machine 10 is increased overall.

If the workload of the piecing robots changes here also, as was described for example in the case of FIG. 4*a,* due to temporary blocking of the piecing robot 14*a* by the operator 26, then here too new operating zones C', D' are defined. In this case, there is no overlapping zone because the piecing robot 14*a* has a high workload in its new zone C'. Since the density of piecing stations requiring servicing is very high in the new operating zone C', an overlapping of the operating zones between C' and D' would lead to a mutual interference of the piecing robots 14*a,* 14*b* with each other, so that the latter would alternately wait for the other service unit 14*a* to liberate a spinning station in need of service. This involves the danger of reducing the efficiency of the servicing system overall, so that in this case a sharp separation of the operating zones is to be preferred.

As shown in FIG. 4*a,* the piecing robot 14*a* is located outside the operating zone A' assigned to it following the new definition of the operating zones. The controls then cause the piecing robot 14*a* to be moved into the operating zone A'. If the operator 26 is still engaged in manual maintenance work at the piecing stations during this travel to the operating zone A', a detection device, e.g. the switching hoop 24 with the switching unit 23 detects the operator 26. The automatic control of the travel movement of the piecing robot 14*a* is then interrupted, e.g. if a travel movement to the right has led to the detection of the obstacle 26 after three travel attempts. Alternatively, the operator pushes the piecing robot 14*a* manually (see above) to the left. In that case the travel movement control of the piecing robot 14*a* is also interrupted. During the displacement of the piecing robot 14*a* by the operator 26, a sensor of the piecing robot 14*a* records the distance covered, so that a new initialization is not necessary when the piecing robot is put back into operation (see above). Once the operator 26 has released the automatic travel, e.g. by actuating the middle key of the input device 45, the piecing robot 14*a* continues its travel into the A'.

If the travel of the piecing robot 14*a* is interrupted for a longer period of time, e.g. longer than 3 to 5 minutes, a new distribution of the operating zones can be made in the sense that the piecing robot 14*a* shares a smaller spinning station zone jointly with the piecing robot 14*b* while the operating zone of the piecing robot 14*c* is extended and takes over part of the spinning stations 13 alongside the guide rail 15 in addition to a portion of the spinning stations 13 alongside the guide rail 16. In order to service the new operating zone of the piecing robot 14*c,* latter travels around the round curve 17 so that the piecing robot 14*c* services portions of both sides of the rotor-spinning machine 10. Since the efficiency of the piecing robot 14*c* is lowered by the travel around the round curve 17, its zone of spinning stations 13 alongside guide rail 13 is reduced while the operating zone of the piecing robot 14*d* is enlarged in proportion.

It should be apparent to those skilled in the art that various modifications and variations can be made to the embodiments described above without departing from the scope and spirit of the invention. It is intended that the invention include such modifications and variations as come within the appended claims and their equivalents.

What is claimed is:

1. A process for controlling travel movement of a service unit at a rotor spinning machine, comprising:

assigning an operating zone to the service unit, the operating zone having a plurality of processing stations serviced by the service unit;

monitoring and detecting the position of the service unit relative to the spinning machine; and moving the service unit back to its assigned operating zone upon detection that the service unit is beyond its respective assigned operating zone by automatically reversing the travel movement of the service unit, if the service unit is moving in a direction away from its assigned operating zone.

2. The process as in claim 1, wherein at least a second service unit is also controlled, and further comprising detecting the position of the first and second service units and maintaining a minimum distance between the servicing units based upon the detected positions.

3. The process as in claim 1, wherein the position detection of the service unit and movement back to its operating zone is an automatic movement control process, and further comprising interrupting the automatic movement control process upon any one of a) the service unit moving further away from its assigned operating zone; b) the service unit is taken out of its assigned operating zone; or c) the service unit is stopped.

4. The process as in claim 3, further comprising continuing to detect the position of the service unit when the automatic movement control process is interrupted.

5. The process as in claim 1, wherein service functions of the service unit are controlled by an automatic control mode process, and further comprising interrupting the automatic control mode process upon any one of a) the service unit moving further away from its assigned operating zone; b) the service unit is taken out of its assigned operating zone; or c) the service unit is stopped.

6. The process as in claim 5, further comprising continuing to detect the position of the service unit when the automatic control mode process is interrupted.

7. A process for controlling travel movement of a service unit at a rotor spinning machine, comprising:

assigning an operating zone to the service unit, the operating zone having a plurality of processing stations serviced by the service unit;

monitoring and detecting the position of the service unit relative to the spinning machine;

moving the service unit back to its assigned operating zone upon detection that the service unit is beyond its respective assigned operating zone; and servicing processing stations with the service unit that are disposed along a path of travel of the service unit back to its assigned operating zone.

8. A process for controlling the travel movement of at least two service units at a rotor spinning machine, comprising:

assigning a separate operating zone to each of the service units, the operating zone having a plurality of processing stations serviced by the respective service unit; and defining the size of the respective operating zones for each of the service units as a function of workload or work efficiency of the service units.

9. The process as in claim 8, further comprising monitoring the workloads and efficiencies of the service units, and redefining the respective operating zones as a function of changed workloads or efficiencies.

10. The process as in claim 8, wherein the respective operating zones overlap, the size of the overlap defined as a function of workloads or efficiencies of the service units.

11. The process as in claim 8, wherein the size of the respective operating zones are empirically calculated.

12. The process as in claim 8, wherein the operating zone of at least one service unit is defined as a function of the type of service to be performed by the service unit at the processing stations.

13. The process as in claim 8, further comprising controlling movement of the service units to their assigned operating zones by detecting the position of the service units relative to the spinning machine, and moving the service units to their assigned operating zone upon detection that a service unit is beyond its respective assigned operating zone.

14. A process for controlling the travel movement of at least two service units at a rotor spinning machine, comprising:

assigning an operating zone to each of the service units, the operating zone having a plurality of processing stations serviced by the respective service unit;

defining the size of the respective operating zones as a function of workload or work efficiency of the servicing units; and wherein the size Na of the operating zone for the first service unit and the size Nb of the operating zone for the second service unit are empirically calculated as follows:

$Na=N/2\ (100\%-a+b)$ $Nb=N/2\ (100\%+a-b)$ a=workload of the first servicing unit b=workload of the second servicing unit N=total number of processing stations to be serviced by the two service units.

15. A process for controlling the travel movement of at least two service units at a rotor spinning machine, comprising:

assigning an operating zone to each of the service units, the operating zone having a plurality of processing stations serviced by the respective service unit;

defining the size of the respective operating zones as a function of workload or work efficiency of the servicing units; and adding to an operating zone for a first service unit a portion of an operating zone of a second servicing unit that cannot be serviced by the second servicing unit.

16. A textile machine having a plurality of spinning processing stations and at least one traveling service unit for servicing said processing stations, and further comprising:

a detection system operatively configured between said service unit and said processing stations that detects a position of said service unit as it travels alongside of said processing stations;

a control system configured with said service unit, said control system automatically controlling movement of said service unit by a process wherein:

an operating zone is assigned to the service unit, said operating zone having a plurality of said processing stations serviced by said service unit;

position of said service unit relative to said processing stations is monitored and detected; and said service unit is moved to its assigned operating zone upon detection that said service unit is beyond its respective assigned operating zone by automatically reversing the travel movement of said service unit, if said service is moving in a direction away from its assigned operating zone.

17. A textile machine having a plurality of spinning processing stations and at least two traveling service units for servicing said processing stations, and further comprising:

a control system configured with said service units, said control system automatically controlling movement of said service units by a process wherein:

a separate operating zone is assigned to each of said service units, said operating zone having a plurality of said processing stations serviced by said respective service unit; and the size of said respective operating zones for each of said service units is defined as a function of workload or work efficiency of said service units.

* * * * *